United States Patent [19]

Manion et al.

[11] 4,369,811

[45] Jan. 25, 1983

[54] NULL BALANCING FOR FLUIDIC SENSORS AND AMPLIFIERS

[75] Inventors: Francis M. Manion, Rockville; Charles E. Paras, Suitland, both of Md.

[73] Assignee: The United States of America as represented by the Secretary of the Army, Washington, D.C.

[21] Appl. No.: 953,292

[22] Filed: Oct. 20, 1978

[51] Int. Cl.[3] ..... F15C 1/14

[52] U.S. Cl. ..... 137/819; 137/834; 137/836

[58] Field of Search ..... 137/819, 820, 821, 822, 137/834, 835, 836, 837

[56] References Cited

U.S. PATENT DOCUMENTS

| | | | |
|---|---|---|---|
| 3,170,476 | 2/1965 | Reilly | 137/836 |
| 3,314,294 | 4/1967 | Colston | 137/819 X |
| 3,339,571 | 9/1967 | Hatch, Jr. | 137/819 X |
| 3,926,221 | 12/1975 | Woods | 137/834 |
| 4,164,961 | 8/1979 | Drzewiecki et al. | 137/837 |

*Primary Examiner*—William R. Cline

*Attorney, Agent, or Firm*—Nathan Edelberg; Robert P. Gibson; Saul Elbaum

[57] ABSTRACT

A trim circuit for compensating for null offset of the jet stream in a fluidic transducer, such as an amplifier or jet deflection sensor, includes a flow bias control circuit and a supply sensitive difference flow control circuit. The flow bias control circuit supplies fluid pressure to a pair of symetrically disposed control channels at the input end of the transducer. This fluid pressure tends to decrease the amount of null offset of the jet stream from a central axis of the transducer which intersects a pair of symetrically disposed output channels. The supply sensitive difference flow control circuit removes the null offset remaining after correction by the flow bias control circuit. The supply sensitive difference flow control circuit may be disposed in one of the later stages of a cascaded fluidic amplifier chain or at the control inputs of a single stage transducer or amplifier.

5 Claims, 8 Drawing Figures

NULL BALANCING FOR FLUIDIC SENSORS AND AMPLIFIERS

RIGHTS OF THE GOVERNMENT

The invention described herein may be manufactured, used and licensed by or for the United States government for governmental purposes without the payment to me of any royalty thereon.

BACKGROUND OF THE INVENTION

1. Field of the Invention

The present invention relates to a means for compensating for null offsets in laminar flow jet deflection sensors and fluidic amplifiers.

2. Description of Prior Art

The null balance of jet deflection sensors and amplifiers has been a critical problem since the use of laminar flow devices. Null changes in these sensors and amplifiers are often due to power supply noise. When turbulent flow was utilized in these amplifiers, these effects of null offset were obscured by the large turbulent fluctuations. However, since laminar flow fields are essentially noise-free, these null offset effects are apparent. Jet flows within the fluidic amplifier should be such that equal output pressures are obtained in both output ports when there is no difference in pressure at the control ports. However, due to various nonlinearities in the device itself, a difference in output pressure is often seen even though there is no difference in pressure at the input or control ports. This difference in output in the absence of a difference in pressure at the input is called null offset. This null offset varies as the supply flow varies. Jet offset at the splitter has been found to be the dominant cause of this null offset problem.

In order to overcome this problem of null offset, several fabrication techniques have been attempted with some success. Nevertheless, there exists a need to more accurately null balance a given element by a trim circuit coupled to the basic mechanical device. The purpose of this disclosure is to describe a trim circuit that allows adjustment of the null, and the change in null offset, with supply changes in laminar flow devices.

SUMMARY OF THE INVENTION

Accordingly, it is an object of the present invention to provide a novel trim circuit in order to substantially eliminate the problem of null offset.

It is another object of the invention to provide a means for controlling null offset at the input stages of a fluidic amplifier.

It is still another object of the present invention to provide a trim circuit means for controlling the null offset problem at later stages of a cascaded fluidic amplifier.

It is still another object of the invention to provide a dual means for controlling null offset for a single fluidic amplifier.

It is still another object of the invention to provide a dual means of controlling null offset for a series of cascaded fluidic amplifiers.

These and other objects of the invention are achieved by providing flow bias or controlled pressure at the control inputs to the fluidic amplifier and the introduction of a supply sensitive difference flow at the later stages of a cascaded set of fluidic amplifiers, or in combination with the flow bias means at the control ports. The introduction of flow bias at the control ports reduces the jet offset, but because the control inputs are slightly different, it also introduces a small supply sensitive offset that can be cancelled by the introduction of small supply sensitive difference flow in later stages of a cascaded device. Thus, a dual means of correcting for the null offset problem is required to obtain substantially complete correction.

The flow bias method of controlling null offset is simply a means by which the flow of fluid into the control ports of a fluidic amplifier is controlled by use of a variable resistor which is in series with the supply pressure input flow to the amplifier. By varying the resistance of the variable resistor, which is in series with the supply means and both control ports, the flow of fluid into the respective control ports is varied. In this manner, the flow in the control ports may be maintained at a level at which the effects of the non-linearities in the respective ports do not create a pressure differential on respective sides of the jet. For a chosen operating pressure, the jet is therefore centered on the splitter of the fluidic device. Usually the flow bias method of reducing null offset is utilized near the input of a series of cascaded fluidic amplifiers. In order to further reduce or substantially eliminate the null offset problem, additional means of reducing null offset is used at later stages of a cascaded fluidic amplifier. This consists of utilization of a supply sensitive difference flow at those later stages.

The term "supply sensitive difference flow" is simply a phrase which designates the use of two resistors one at each control port of a later cascaded fluidic amplifier. One resistor is linear and the other resistor is nonlinear in characteristics. As each resistor is varied in its resistance characteristics, the supply pressure being tapped from the main supply line through the resistor is varied. Since this supply pressure is reintroduced into each of the control ports the fluid through each control port can be varied based on variations in the resistance of each of the resistors. This further provides a differential pressure across both of the control ports. This differential pressure can redeflect the jet as it transgresses through the fluidic amplifier in such a way as to cancel out any residual offset or error induced by fluctuations of supply pressure and reposition the jet as close to the null position as possible, that is, directly centered on the splitter.

These and other characteristics of the present invention may be better understood in relation to the drawings and the detailed description to follow.

BRIEF DESCRIPTION OF THE DRAWINGS

FIG. 6 represents the flow-pressure characteristics within each control part (C1 and C2), as a function of resistance $R_L$ and $R_{NL}$, and the resistance characteristics associated with resistors $R_L$ and $R_{NL}$.

FIG. 7 is a diagrammatic illustration of a combined flow biased and supply sensitive difference trim circuit within a single fluidic amplifier.

FIG. 8 is a diagrammatic illustration of a combined flow bias and supply sensitive difference trim circuit used for correcting null offsets within a series of cascaded fluidic amplifiers.

DETAILED DESCRIPTION OF THE INVENTION

Figure 1:
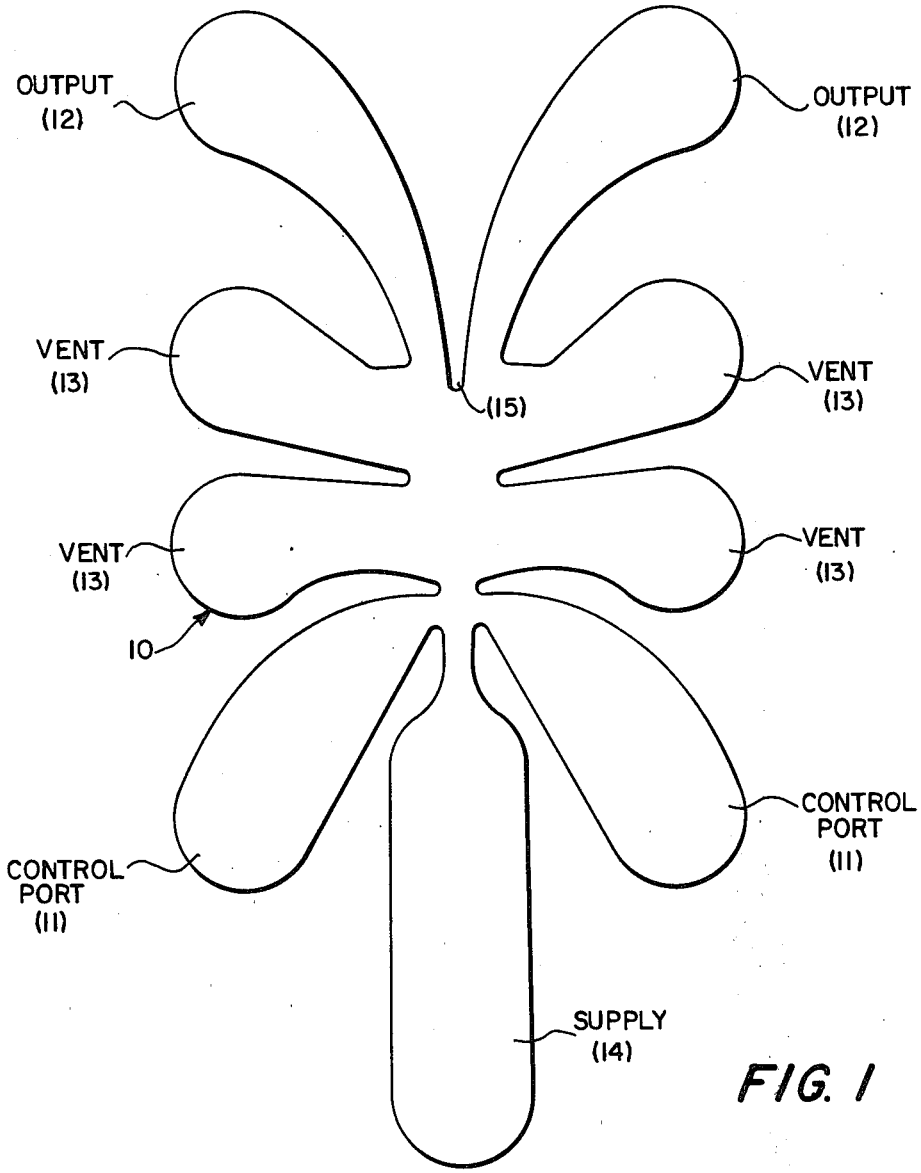
FIG. 1 is a diagrammatic illustration of a typical fluidic amplifier wherein a null offset problem exists.

Referring in detail to FIG. 1 which shows a typical fluidic amplifier 10 with control ports 11 representing the signal input ports to the fluidic amplifier and outputs 12 representing the signal output ports of the amplifier. The vents 13 simply vent excess fluid which is unable to exit from the output ports 12 bias to the amplifier of FIG. 1. In operation, the fluid supply 14 flows in a jet stream toward the splitter 15 symetrically disposed with respect to outputs 12. If there is no difference in pressure at the control ports 11, theoretically, there should be no difference in pressure at the output ports 12. The splitter 15 acts as means for splitting the jet stream equally in two directions in such a way as to create equal pressures at both outputs. However, due to inherent nonlinearities in the device such a scheme is not possible. In reality, there exists a difference in output pressure at the output ports 12 absent any differential pressure at the control ports 11. This difference in pressure at the outputs 12 absent a difference in pressure at the control ports 1 is created by the null offset problem to which the present invention is directed.

Figure 2:
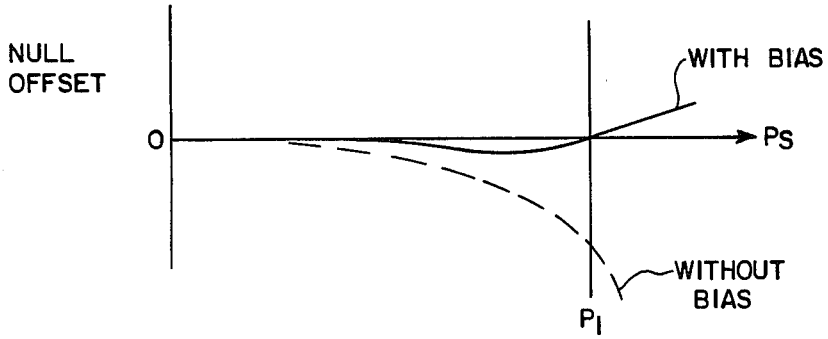
FIG. 2 represents the null offset characteristics as a function of supply pressure, of a fluidic amplifier of the type illustrated in FIG. 1, with and without the bias flow of the present invention.

Referring in detail to FIG. 2, there is illustrated a graphic representation of the null offset problem as a function of pressure. This graphic representation illustrates the performance of the amplifier of FIG. 1 in the absence of any difference in control pressure at the control ports. Notice that, as the pressure increases, the null offset also increases in the absence of any compensation. When the bias flow trim circuit of the present invention is utilized in conjunction with the amplifier, the null offset is very substantially reduced and may be virtually eliminated at a particular operating pressure P1. Null offset still remains slightly sensitive to supply pressure fluctuations, but this may be further compensated by a supply sensitive difference flow.

Figure 3:
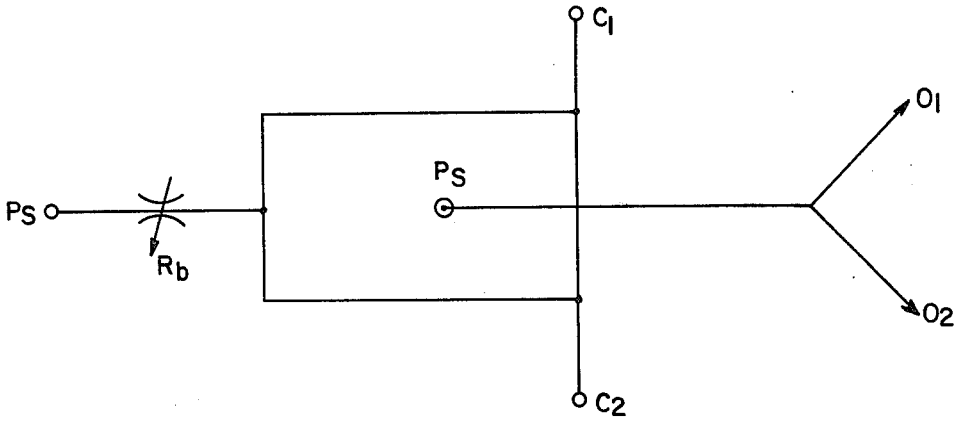
FIG. 3 is a diagrammatic illustration of a flow biased means of the present invention for controlling null offset.

Referring in detail to FIG. 3, there is illustrated an embodiment of the present invention for controlling null offset by varying the flow bias to the control ports C1 and C2. In FIG. 3 a control valve or variable resistor $R_b$ is used in tapping the supply in such a way that part of the flow from the supply is diverted to the control ports C1 and C2 of FIG. 3 to augment the control flows. As the resistor $R_b$ is varied, the flow rate to the control ports is varied in such a way that the pressures in control ports C1 and C2 are regulated. Due to non-linearities or irregularities in the ports, the flows in C1 and C2 vary differently with varying resistance $R_b$. As the pressure at the control ports is varied, the null offset at the output is being minimized.

Figure 4:
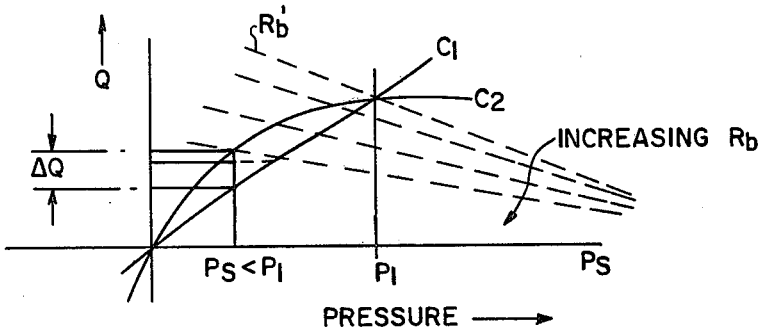
FIG. 4 is a graph illustrating the flow pressure characteristics at each control port C1 and C2 of an amplifier of the type of FIG. 1 as a function of input resistance ($R_B$).

In FIG. 4 a graphic representation of the flow rate vs. supply pressure illustrates typical characteristics at the two control ports C1 and C2. The dashed lines represent various values of $R_b$ and the manner in which $R_b$ is related to the flow Q and pressure P. The arrow indicates the direction in which the resistance $R_b$ increases. As the resistance $R_b$ is varied, the pressure into each of the control ports C1, C2 is also varied each according to its own characteristic curve. Referring to FIG. 4, as this pressure at the control ports C1, C2 is decreased below the pressure $P_1$, the flow rates Q also vary. At a pressure $P_s$ less than $P_1$, a difference in flow ($\Delta Q$) is created, which is the difference between the flow rates through the respective control ports C1, C2. This difference in flow creates a differential pressure which will substantially compensate for the null offset problem of the amplifier. If the null offset results from non-linearities within the control ports, as will be presumed in the instant example, $R_b$ may be adjusted to the level $R_b'$ to adjust the pressure in the ports to P1 at which point ports C1 and C2 will be at equal pressures. This will eliminate the offset.

Figure 5:
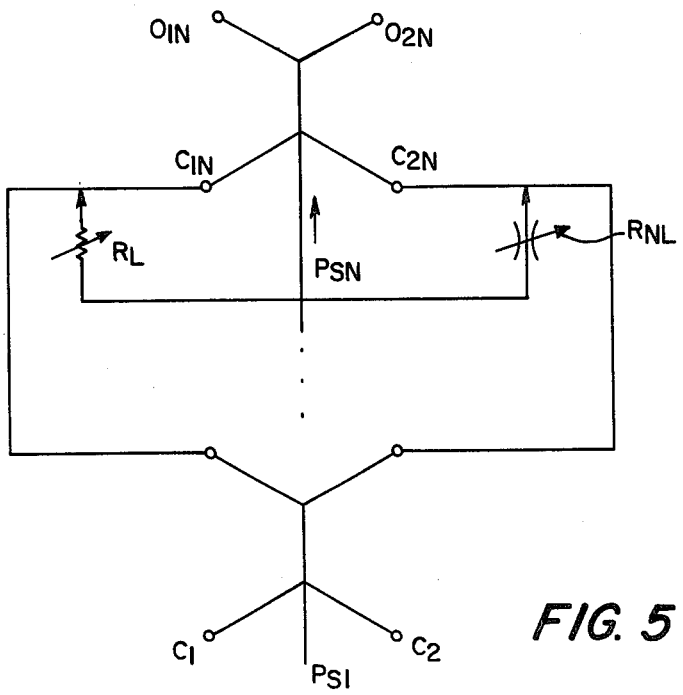
FIG. 5 is a diagrammatic view of a supply sensitive difference method of controlling null offset within a plurality of cascaded fluidic amplifiers of types similar to that depicted in FIG. 1.

An alternative embodiment to the subject invention appears in FIG. 5. This figure represents an alternative or additional means of compensating for null offset by using a supply sensitive difference circuit for compensating for null offset. FIG. 5 illustrates a series of cascaded fluidic amplifiers whereby the Nth amplifier is shown in a series of cascaded fluidic amplifiers. Note that a linear resistor $R_L$ and a nonlinear resistor $R_{NL}$ are used to tap the main supply jet $P_{SN}$ appearing in FIG. 5. Each of these resistors are variable. Therefore, the resistances thereof can be changed in such a way as to compensate for the null offset problem.

The characteristics of each of these resistors are illustrated in FIG. 6. In FIG. 6 we note a curve $C1_N$ corresponding to the control function of $R_L$ and another curve $C2_N$ corresponding to the control function of $R_{NL}$. At a certain point along both of the curves, where they intersect, a certain pressure $P_1$ exists. At this pressure, the pressure through the control ports are the same. In FIG. 6 the $C1_N$ curve represents the flow into the first control port $C1_N$ of FIG. 5 and the pressure that exists at that control port $C1_N$. The curve itself represents the control function characteristics of the resistance $R_L$ appearing in FIG. 5. Remembering that $P_1$ is the operating point at which the null offset problem is zero (see FIG. 2), and at this pressure, $P_1$ and the resultant flow $Q_1$, through each control port, theoretically has a null offset of approximately zero. If we vary the supply pressure through the main supply jet in such a way that the pressure $P_s$ is less than $P_1$, a differential flow rate will result $\Delta Q$ (see FIG. 6). Using these resistances $R_L$ and $R_{NL}$ the required difference in flow through the control ports $C1_N$ and $C2_N$ is generated in response to supply pressure fluctuations in order to offset the null offset problem. This is $\Delta Q$ as illustrated in FIG. 5.

Referring to FIG. 7 there is illustrated a combined flow bias and a supply sensitive difference flow method of offsetting a null offset problem in a single fluidic amplifier. That is the compensation techniques of both FIGS. 3 and 5 are combined into a single trim circuit. In FIG. 7, $R_L$ and $R_{NL}$ represent the supply sensitive difference flow method of reducing null offset whereas $R_b$ is the representative element for supplementing the flow-bias technique.

Referring to FIG. 8 there is illustrated a combined flow bias method of FIG. 3 and the supply sensitive difference flow method of FIG. 5 for controlling null offset in a series of cascaded fluidic amplifiers. In FIG.

8, the resistance $R_b$, when varied will compensate for the initial null offset problem appearing at the earlier stages of the cascaded amplifier. The supply sensitive difference flow technique of FIG. 5 is utilized at the later stages of the cascaded amplifier as illustrated by the resistance $R_L$ and $R_{NL}$ in FIG. 7. This will operate as a final compensating method of reducing or eliminating the remaining null offset problem characteristic of these devices.

We wish it to be understood that we do not desire to be limited to the exact details of construction shown and described for obvious modifications can be made by a person skilled in the art.

We claim:

1. A fluidic transducer comprising:

an input end and an output end disposed on an axis extending through said transducer;

at least two output signal channels at said output end symetrically disposed on opposite sides of said axis;

a first input signal control channel means disposed on one side of said axis;

a second input signal control channel means disposed on an opposite side of said axis;

source means for directing a jet stream of fluid substantially along said axis from said input end of said transducer to said output end thereof, said jet stream being offset by a predetermined distance from said axis at said output end when no input signals are applied to said control channels;

first regulating means for supplying fluid at a selected flow rate to said control channel means to substantially reduce the amount of offset of said jet stream from said axis; and second regulating means for individually supplying fluid at selected flow rates to each one of said input signal control channel means to substantially remove the amount of offset not removed by said first means.

2. A fluidic transducer in accordance with claim 1, wherein said first regulating means comprises:

conduit means in fluid communication with said source means and both said control channels; and a single fluid flow rate adjustment means in said conduit means.

3. A fluidic transducer in accordance with claim 2, wherein said adjustment means comprises a variable flow resistance device.

4. A fluidic transducer in accordance with claim 1, wherein said second means for individually supplying a selected fluid flow rate comprises:

a linear resistance device;

a non-linear resistance device;

wherein said linear resistance device and said non-linear resistance device are both connected at one end to said source means;

wherein said linear resistance device is connected at its other end to a first control channel and said non-linear resistance device is connected at its other end to a second control channel.

5. A cascaded group of fluidic transducers, each of said transducers having an input end and an output end disposed on an axis extending through said transducer, at least two output signal channels at said output end symetrically disposed on opposite sides of said axis, at least two input signal control channels at said input end disposed on opposite sides of said axis, and source means for directing a jet stream of fluid substantially along said axis from said input end of said transducer to said output end thereof, said jet stream being offset by a predetermined distance from said axis at said output end when no input signals are applied to said control channels, the output signal channels of each of said transducers being coupled to the input signal control channels of the next successive transducer in said cascaded group, the improvement comprising:

first regulating means for supplying fluid at a selected flow rate to said at least two input signal control channels of the first transducer of the cascaded group to substantially reduce the amount of offset of said jet stream from said axis; and second regulating means for individually supplying fluid at selected flow rates to each of one of the input signal control channels of a selected one of said transducers other than the first transducer to substantially remove the amount of offset not removed by said first means.

* * * * *